US010633162B2

(12) United States Patent
Bower et al.

(10) Patent No.: US 10,633,162 B2
(45) Date of Patent: Apr. 28, 2020

(54) ANGLE PROTECTOR

(71) Applicant: USG BORAL BUILDING PRODUCTS PTY LIMITED, Sydney, New South Wales (AU)

(72) Inventors: Brenton Bower, Brisbane (AU); Wayne Scott, Carole Park (AU)

(73) Assignee: USG BORAL BUILDING PRODUCTS PTY LIMITED (AU)

( * ) Notice: Subject to any disclaimer, the term of this patent is extended or adjusted under 35 U.S.C. 154(b) by 32 days.

(21) Appl. No.: 15/746,899

(22) PCT Filed: Jul. 27, 2015

(86) PCT No.: PCT/IB2015/001623

§ 371 (c)(1),
(2) Date: Jan. 23, 2018

(87) PCT Pub. No.: WO2017/017489

PCT Pub. Date: Feb. 2, 2017

(65) Prior Publication Data

US 2018/0312319 A1 Nov. 1, 2018

(51) Int. Cl.
*B65D 81/05* (2006.01)
*B65D 71/04* (2006.01)
*B61D 45/00* (2006.01)

(52) U.S. Cl.
CPC ..... *B65D 81/054* (2013.01); *B61D 45/008* (2013.01); *B65D 71/04* (2013.01)

(58) Field of Classification Search
CPC .... B65D 81/054; B65D 81/053; B65D 71/04; B65D 81/05; B61D 45/008
(Continued)

(56) References Cited

U.S. PATENT DOCUMENTS 3,416,652 A * 12/1968 Almasy ..... B65D 71/04 206/453
4,202,449 A * 5/1980 Bendt ..... B65D 81/054 206/453
(Continued)

FOREIGN PATENT DOCUMENTS

CN 201116194 9/2008
CN 203753619 8/2014
(Continued)

OTHER PUBLICATIONS

International Search Report and Written Opinion corresponding to International Patent Application No. PCT/IB2015/001623, dated Nov. 23, 2015.
(Continued)

*Primary Examiner* — Steven A. Reynolds
(74) *Attorney, Agent, or Firm* — McAndrews, Held & Malloy, Ltd.

(57) ABSTRACT

An angle protector for preventing damage to goods during transport and methods of use are provided. The angle protector includes a top end, base end, corner portion, top portion, and base portion. The corner portion includes an inside surface and an outside surface. The corner portion is positioned between the top end and the base end. The top portion extends between the corner portion and the top end. The top portion includes an arch and at least one fin. The arch includes a generally convex outside surface and a generally concave inside surface. The arch extends between the top end and the corner portion. The at least one fin extends at an angle toward the top end from the generally concave inside surface of the arch. The base portion includes an inside surface and an outside surface. The base portion extends between the corner portion and the base end.

20 Claims, 5 Drawing Sheets

(58) Field of Classification Search
USPC ..... 206/586, 453, 597
See application file for complete search history.

(56) References Cited

U.S. PATENT DOCUMENTS

| | | | | | |
|---|---|---|---|---|---|
| 4,742,916 | A * | 5/1988 | Galea | B65D 81/054 | 206/586 |
| 4,877,673 | A * | 10/1989 | Eckel | B65D 81/054 | 428/172 |
| 5,045,374 | A | 9/1991 | Tucker | | |
| 5,772,037 | A * | 6/1998 | Hurley | B65D 81/054 | 206/586 |
| 5,918,800 | A * | 7/1999 | Goshorn | B60P 7/0869 | 229/199 |
| 6,039,184 | A * | 3/2000 | Gale | B65D 81/056 | 206/586 |
| 6,286,683 | B1 * | 9/2001 | Hunt | B65D 81/054 | 206/320 |
| 6,470,637 | B2 * | 10/2002 | Gratz | E06B 7/00 | 206/453 |
| 10,221,003 | B2 * | 3/2019 | Ayala | B65D 81/054 | |
| 2002/0144923 | A1 * | 10/2002 | Baechle | B65D 81/054 | 206/453 |
| 2006/0186017 | A1 * | 8/2006 | Markert | B65D 81/053 | 206/568 |
| 2006/0243621 | A1 | 11/2006 | Kruelle et al. | | |

FOREIGN PATENT DOCUMENTS

| | | |
|---|---|---|
| DE | 29813133 | 1/1999 |
| DE | 19904843 | 8/2000 |
| DE | 20117852 | 1/2002 |
| DE | 102010018651 | 11/2011 |
| DE | 202013002167 | 4/2013 |
| GB | 1598411 | 9/1981 |
| KR | 20090010603 | 10/2009 |
| WO | 2011/135015 | 4/2011 |

OTHER PUBLICATIONS

First Office Action for Chinese Patent Application No. 201580083410, filed Jul. 27, 2015, dated Feb. 2, 2019, 18 pages.

* cited by examiner

ANGLE PROTECTOR

CROSS-REFERENCE TO RELATED APPLICATIONS/INCORPORATION BY REFERENCE

[Not Applicable]

FEDERALLY SPONSORED RESEARCH OR DEVELOPMENT

[Not Applicable]

MICROFICHE/COPYRIGHT REFERENCE

[Not Applicable]

FIELD OF THE INVENTION

Certain embodiments of the invention relate to systems and methods for protecting goods during transport, such as by airplanes, trains, automobiles, boats, and the like. More specifically, certain embodiments provide an angle protector that is placed at top, corner edges of stacks of goods between the goods and tie down straps to prevent damage to the goods while in transit. In various embodiments, the goods may be building products, such as plasterboard, fiber cement, timber plywood, and the like.

BACKGROUND OF THE INVENTION

Plasterboard, also referred to as drywall, wallboard, gypsum board, and the like, is a building material commonly used to make interior walls and ceilings. Plasterboard is a panel made of gypsum plaster pressed between two thick sheets of paper. Damage to plasterboard during transport has been widely accepted in the building industry. During transport, packs of plasterboard are secured to transporter equipment by tie down straps. Many transport carriers do not understand the fragile nature of the product and strap down the packs of plasterboard until there is no more tension that can be applied.

Accordingly, the most common form of damage to packs of plasterboard is cracked recesses in the top four to six sheets in the top packs in a stack that are caused by clamping down the tie down straps to secure the plasterboard during transit. The damaged product, when received at its destination, may be sold as second grade product, cut down to small sizes, cut up for billets, and/or written off. Although the building material and transport company industries have attempted different types of materials and strapping methods that have had some success in reducing damage for local deliveries, none have been successful for bulk loads of product being shipped over longer distances where the product is tightly secured to limit movement.

Further limitations and disadvantages of conventional and traditional approaches will become apparent to one of skill in the art, through comparison of such systems with some aspects of the present invention as set forth in the remainder of the present application with reference to the drawings.

BRIEF SUMMARY OF THE INVENTION

Systems and methods are provided for preventing damage to goods during transport, substantially as shown in and/or described in connection with at least one of the figures, as set forth more completely in the claims.

These and other advantages, aspects and novel features of the present invention, as well as details of an illustrated embodiment thereof, will be more fully understood from the following description and drawings.

DETAILED DESCRIPTION

Figure 1:
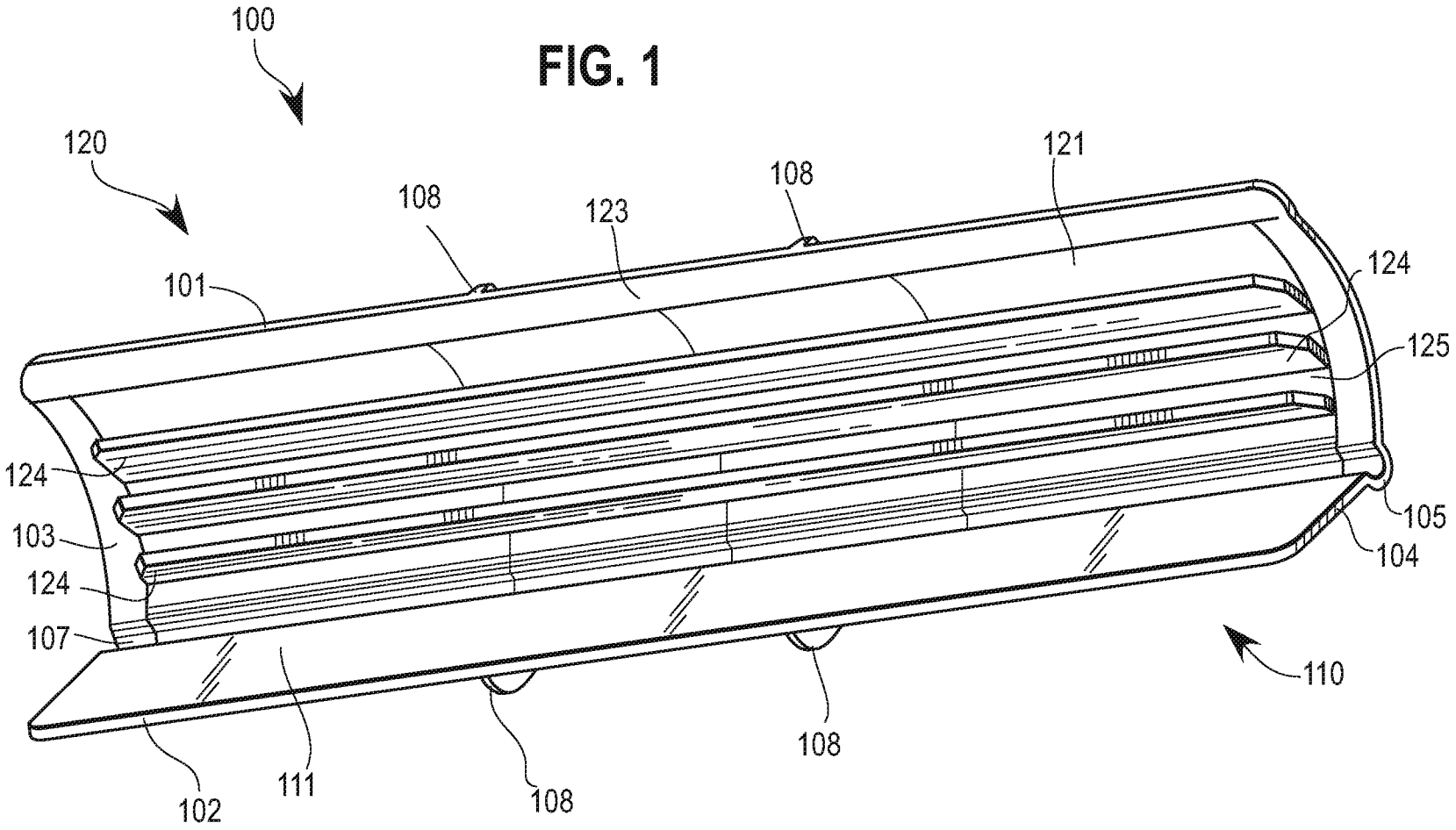
FIG. 1 is a diagram that illustrates an interior perspective view of an exemplary angle protector for preventing damage to goods during transport in accordance with an embodiment of the present invention.

Certain embodiments of the invention may be found in systems 100 and methods 200 for protecting goods during transport, such as by air, water, road, rail, or the like. More specifically, certain embodiments provide an angle protector 100 that is placed at top, corner edges of stacks of goods between the goods and tie down straps to prevent damage to the goods while in transit.

Various embodiments provide an angle protector 100 for preventing damage to goods during transport and methods 200 of use. The angle protector 100 includes a top end 101, base end 102, corner portion 105, top portion 120, and base portion 110. The corner portion 105 includes an inside surface 107 and an outside surface 106. The corner portion 105 is positioned between the top end 101 and the base end 102. The top portion 120 extends between the corner portion 105 and the top end 101. The top portion 120 includes an arch 125 and at least one fin 124. The arch 125 includes a generally convex outside surface 122 and a generally concave inside surface 121. The arch 125 extends between the top end 101 and the corner portion 105. The at least one fin 124 extends at an angle toward the top end 101 from the generally concave inside surface 121 of the arch 125. The base portion 110 includes an inside surface 111 and an outside surface 112. The base portion 110 extends between the corner portion 105 and the base end 102.

As used herein, the terms "exemplary" or "example" means serving as a non-limiting example, instance, or illustration. As used herein, the term "e.g." introduces a list of one or more non-limiting examples, instances, or illustrations.

As used herein, an element recited in the singular and proceeded with the word "a" or "an" should be understood as not excluding plural of the elements, unless such exclusion is explicitly stated. Furthermore, references to "an embodiment," "one embodiment," "a representative embodiment," "an exemplary embodiment," "various embodiments," "certain embodiments," and the like are not intended to be interpreted as excluding the existence of additional embodiments that also incorporate the recited features. Moreover, unless explicitly stated to the contrary, embodiments "comprising," "including," or "having" an element or a plurality of elements having a particular property may include additional elements not having that property.

Although certain embodiments in the foregoing description may be described in reference to preventing damage to building materials such as plasterboard, unless so claimed, the scope of various aspects of the present invention should not be limited to stacks of plasterboard packs and may additionally and/or alternatively be applicable to fiber cement, timber plywood, any suitable building materials, or any suitable goods.

Figure 2:
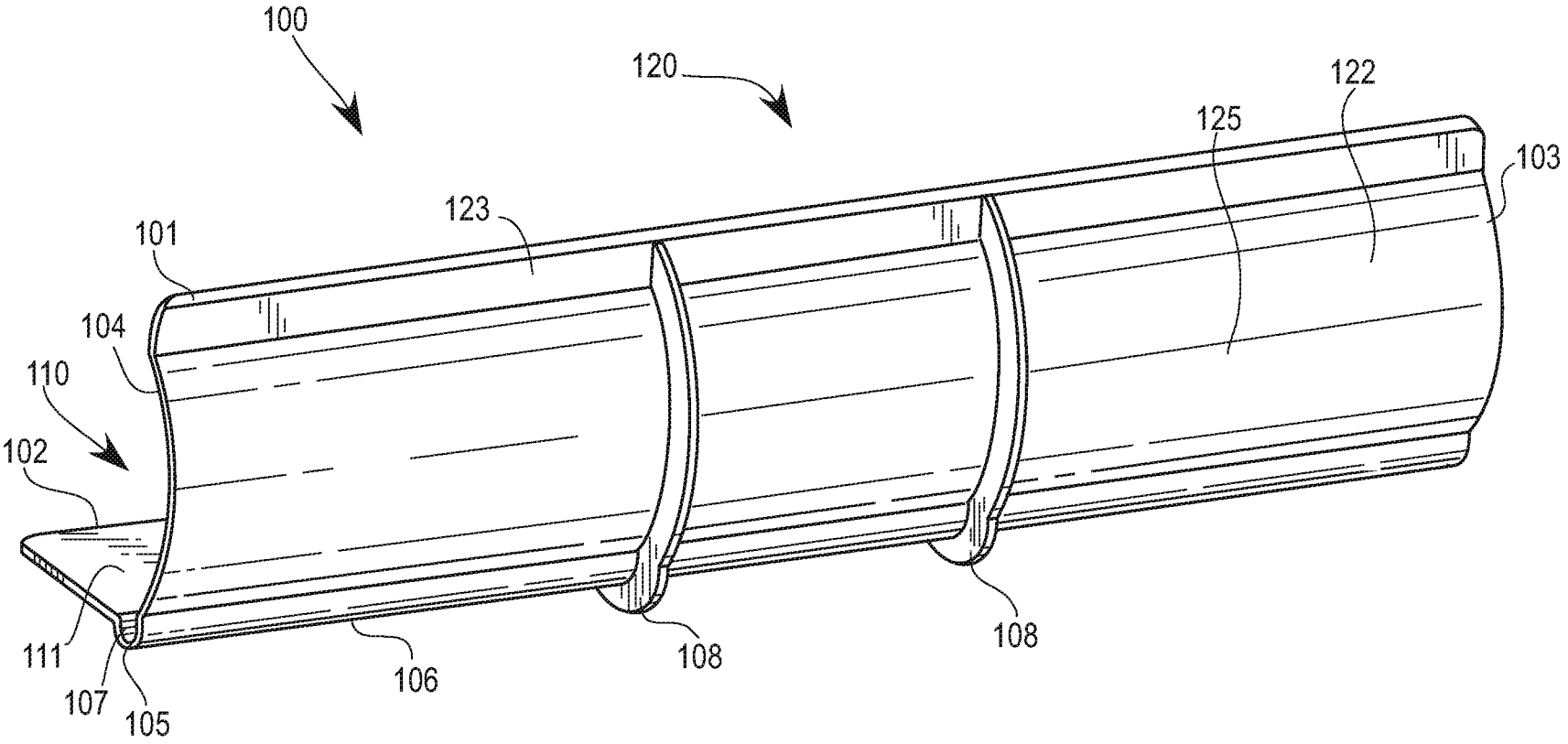
FIG. 2 is a diagram that illustrates an exterior perspective view of an exemplary angle protector for preventing damage to goods during transport in accordance with an embodiment of the present invention.
Figure 3:
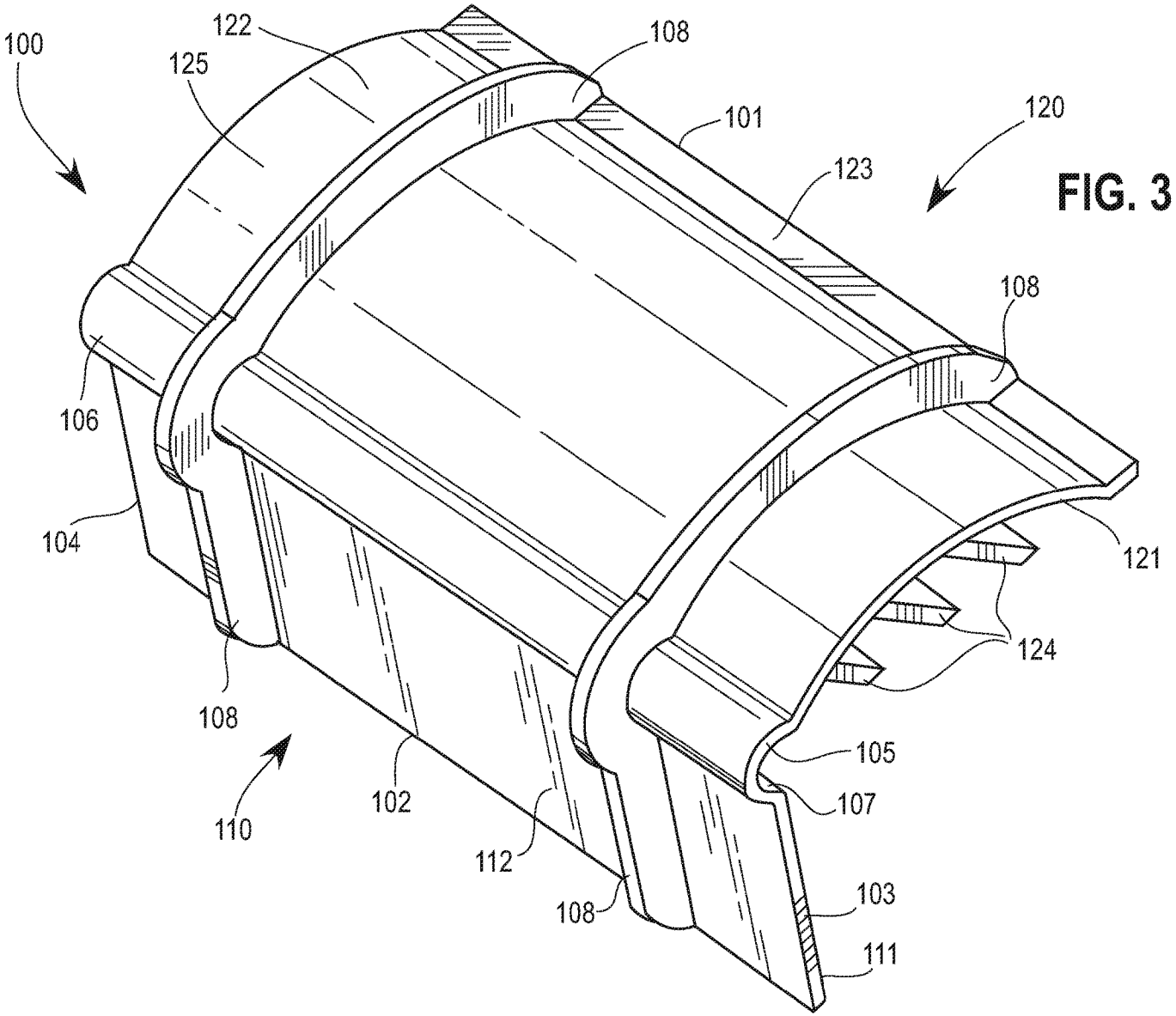
FIG. 3 is a diagram that illustrates an exterior perspective view of an exemplary angle protector for preventing damage to goods during transport in accordance with an embodiment of the present invention.
Figure 4:
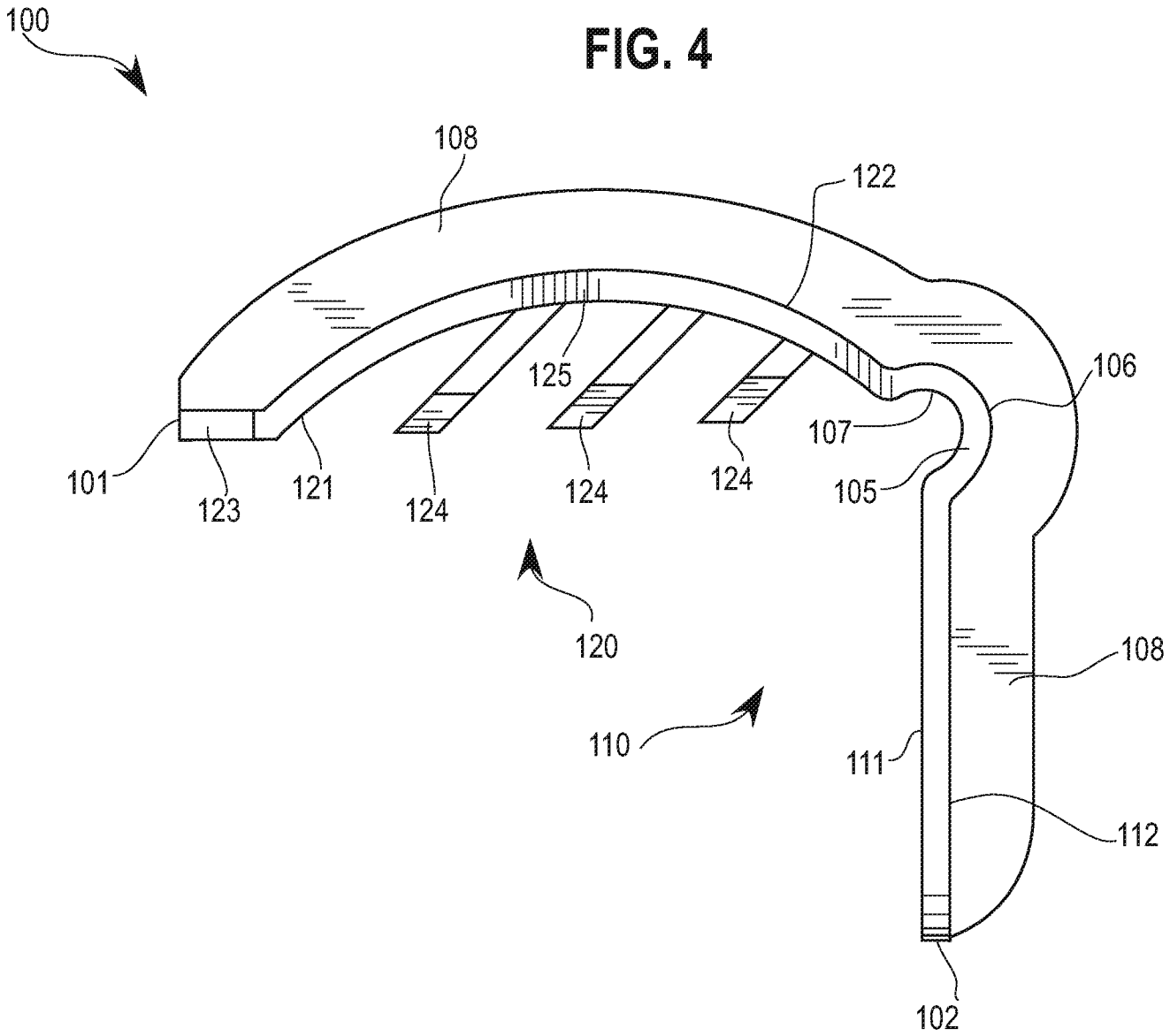
FIG. 4 is a diagram that illustrates a side view of an exemplary angle protector for preventing damage to goods during transport in accordance with an embodiment of the present invention.

FIG. 1 is a diagram that illustrates an interior perspective view of an exemplary angle protector 100 for preventing damage to goods during transport in accordance with an embodiment of the present invention. FIGS. 2-3 are diagrams that illustrate exterior perspective views of an exemplary angle protector 100 for preventing damage to goods during transport in accordance with an embodiment of the present invention. FIG. 4 is a diagram that illustrates a side view of an exemplary angle protector 100 for preventing damage to goods during transport in accordance with an embodiment of the present invention.

Referring to FIGS. 1-4, an angle protector 100 is shown having a base portion 110, a top portion 120, and a corner portion 105. The base 110, top 120, and corner 105 portions may be integrated or fixably attached to each other. The angle protector 100 may be constructed of plastic, such as a polycarbonate (PC) acrylonitrile-butadiene styrene (ABS) alloy, or any suitable material. The angle protector 100 comprises sides 103, 104 and extends from a top end 101 at the top portion 120 to a base end 102 at the base portion 110. The top portion 120 is generally perpendicular to the base portion 110. The top 120 and base 110 portions come together at the centrally-located corner portion 105.

The base portion 110 comprises an interior surface 111 and an exterior surface 112. The interior surface 111 can be flat or have ridges, for example. The interior surface 111 is placed against the sides of a pack of goods, such as building materials, and may be pressed against the building materials when a tie strap guided over the exterior surfaces 106, 112, 122 of the angle protector 100 is tightened. The exterior surface 112 may be a flat surface opposite the interior surface 111.

The exterior surface 112 of the base portion 110 may include tie strap guides 108 that protrude from the exterior surface 112 and extend from the base end 102 to the top end 101. The tie strap guides 108 may be, for example, integrated with or attached to the exterior surfaces 106, 112, 122 of the angle protector 100. In various embodiments, two tie strap guides 108 may protrude generally perpendicularly from the exterior surfaces 106, 112, 122 such that a tie strap can be placed between the guides 108 and prevent the tie straps from sliding off the angle protector 100. Although two tie strap guides 108 are shown in FIGS. 1-4, additional tie strap guides 108 are envisioned to provide alternate tie strap positions and/or to allow for additional tie straps to be guided across the exterior surfaces 106, 112, 122 of the angle protector 100. For example, three tie strap guides 108 may provide two tie strap channels, four tie strap guides 108 can provide three tie strap channels, and the like.

The corner portion 105 includes an interior surface 107 and an exterior surface 106. The corner portion may be centrally-located between the top portion 120 and the base portion 110, providing the corner connection between these portions 110, 120. The corner portion 105 may be generally C-shaped to provide the corner connection while forming a groove that extends between sides 103, 104. The groove created by the C-shaped corner portion 105 may provide a buffer that prevents or reduces contact between the corner portion 105 and the top corner edge of the building materials or other goods. The interior 107 and exterior 106 surfaces may be flat, C-shaped surfaces, for example. The tie strap guides 108 may extend from the exterior surface 106 to restrict movement of a tie strap placed therebetween.

The top portion 120 comprises an inside surface 121, an outside surface 122, a foot 123, fins 124, and an arch 125. The top portion 120 extends from the corner portion 105 to the top end 101. The foot 123 extends between sides 103, 104 of the angle protector 100 at the top end 101. The foot 123 has a generally flat inside surface 121 that rests on the top sheet of a pack of building materials or other goods. The arch 125 is a curved section of the top portion 120 that extends between sides 103, 104 and spans between the corner portion 105 and the foot 123. The inside surface 121 of the arch may be a generally concave surface and the outside surface 122 can be a generally convex surface, for example. The outside surface 122 of the foot 123 and arch 125 may include tie down straps 108 for restricting movement of a tie down strap placed between the guides 108.

The inside surface 121 of the arch 125 includes a plurality of fins 124. The fins may be integrated with and/or fixably attached to the top portion 120. Although three fins 124 are shown in FIGS. 1, 3, and 4, more or less fins 124 are contemplated. For example, the top portion 120 may include one, two, four, five, six, or any suitable number of fins 124.

Still referring to FIGS. 1-4, the fins 124 extend at an angle from the inside surface 121 at one end toward the foot 123. In certain embodiments, the angle each of the fins 124 extend from the inside surface 121 of the arch 125 may be approximately 30-60 degrees. The fins 124 may end, for example, along a substantially same plane as the inside surface 121 of the foot 123. Accordingly, the length of each of the fins 124 may vary based on the position of the fin 124 in the inside surface 121 of the arch 125. As an example, the ends of the fins 124 and the inside surface 121 of the foot 123 may contact the top sheet of a pack of building materials if the angle protector 100 is appropriately placed at a top edge of a top pack of a stack of building materials.

The fins 124 may be evenly spaced along the inside surface 121 of the arch 125. In various embodiments, the first fin 124 nearest the corner portion 105 may be located approximately 45 millimeters (e.g., 40-60 millimeters) in from the corner portion 105 such that pressure is not applied to, for example, a recess of the building materials. The fins 124 provide a spring-like effect by absorbing tension to prevent damage to the building materials when the tie down straps are tightened. In use, tie down straps may be tightened over the angle protector 100 at a pressure of over 450 kilograms without damaging the angle protector 100 or building materials. In various embodiments, up to 850 kilograms of tension can be applied to the angle protector 100 without damaging the protector 100.

Figure 5:
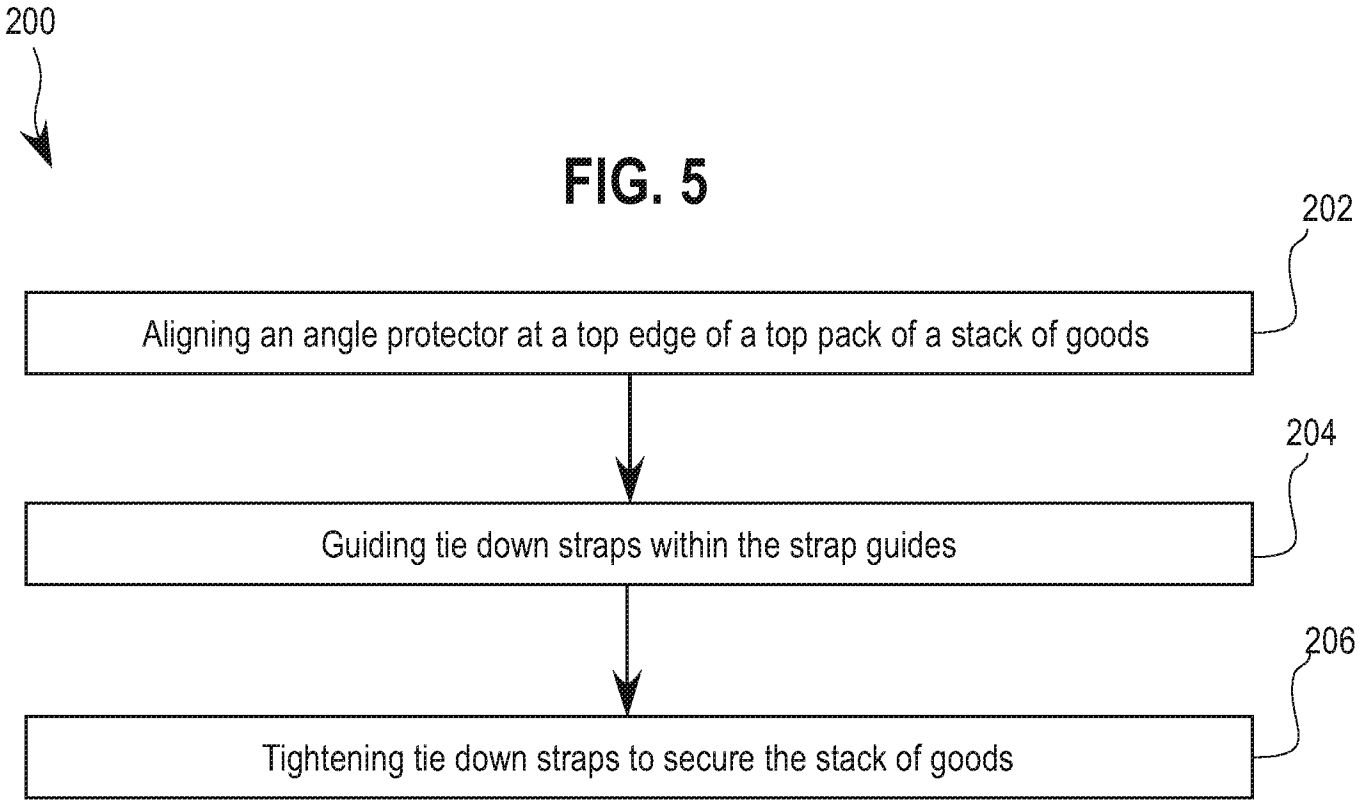
FIG. 5 is a flow diagram that illustrates exemplary steps for securing goods with an angle protector for preventing damage to the goods during transport in accordance with an embodiment of the present invention.

FIG. 5 is a flow diagram 200 that illustrates exemplary steps 202-206 for securing goods with an angle protector 100 to prevent damage to the goods during transport in accordance with an embodiment of the present invention. Referring to FIG. 5, there is shown a flow diagram 200, which illustrates exemplary steps 202-206 for securing goods with an angle protector 100. At step 202, an angle protector 100 is aligned at a top edge of a top pack of a stack of goods, such as building materials. At step 204, one or more tie down straps are guided within tie down strap guides 108 of the angle protector 100. At step 206, the tie down straps are tightened over the angle protector 100 to secure the stack of goods. Although the method is described with reference to the exemplary elements of the systems described above, it should be understood that other implementations are possible.

At step 202, an angle protector 100 is aligned at a top edge of a top pack of a stack of building materials or other goods. For example, one or more packs of plasterboard may be stacked horizontally on pallets or any suitable transport device. Angle protectors 100 are placed across from each other at top edges of the top pack of the stack of plasterboard. The inside surface 111 of the base portion 110 of each of the angle protectors 100 may be placed against a vertical side of the stack of plasterboard. The corner portion 105 may wrap around the top edge of the stack of plasterboard. The inside surface 121 of the foot 123 and the ends of the fins 124 extending at an angle toward the foot 123 from the inside surface 121 of the arch 125 of the top portion 120 may rest on the top horizontal surface of the stack of plasterboard.

At step 204, one or more tie down straps are guided within tie down strap guides 108 of the angle protector 100. For example, the angle protectors 100 may comprise tie down strap guides 108 that extend from the base end 102 to the top end 101 on the exterior surfaces 112, 106, 122 of the base 110, corner 105, and top 120 portions. The tie down strap guides 108 form a channel for receiving the placement of the tie down straps. The tie down strap guides 108 prevent the tie down straps from sliding off of the angle protector 100 and onto the building materials or other goods, which could potentially damage the building materials. The tie down straps are extended over two angle protectors 100 aligned with each other across the top edge of the top pack of the plasterboard. In various embodiments, multiple pairs of angle protectors 100 each having a tie down strap routed between the corresponding tie down strap guides 108 can be used to secure the stack of plasterboard.

At step 206, the tie down straps are tightened over the angle protector 100 to secure the stack of building materials or other goods. For example, the tie down straps may be tightened to a pressure of at least 450 kilograms. In certain embodiments, the tie down straps may be tightened up to 850 kilograms of pressure without damaging the angle protectors 100. As the tie down straps are tightened, fins 124 extending from an inside surface 121 of an arch 125 of the top portion 120 of the angle protector 100 provide a spring-like effect by absorbing tension to prevent damage to the plasterboard.

Aspects of the present invention provide an angle protector 100 and methods of use for preventing damage to goods during transport, such as by air, water, road, rail, or the like. The angle protector 100 may comprise a top end 101 and a base end 102. The angle protector 100 may comprise a corner portion 105 having an inside surface 107 and an outside surface 106. The corner portion may be positioned between the top end 101 and the base end 102. The angle protector 100 may comprise a top portion 120 extending between the corner portion 105 and the top end 101. The top portion 120 may comprise an arch 125 having a generally convex outside surface 122 and a generally concave inside surface 121. The arch 125 may extend between the top end 101 and the corner portion 105. The top portion 120 may comprise at least one fin 124 extending at an angle toward the top end 101 from the generally concave inside surface 121 of the arch 125. The angle protector 100 may comprise a base portion 110 extending between the corner portion 105 and the base end 102. The base portion 110 may comprise an inside surface 111 and an outside surface 112.

In a representative embodiment, the top portion 120 comprises a foot 123 having a flat inside surface 121 and an outside surface 122. The foot 123 may extend between the top end 101 and the arch 125. In certain embodiments, the at least one fin 124 comprises a first end at the generally concave inside surface 121 of the arch 125 and a second end that is substantially on a same plane as the flat inside surface 121 of the foot 123. In various embodiments, the corner portion 105 is generally C-shaped. In a representative embodiment, the angle protector 100 is constructed of a polycarbonate acrylonitrile-butadiene styrene alloy.

In certain embodiments, the base portion 110 is generally perpendicular with the top portion 120. In various embodiments, the angle protector 100 comprises a plurality of tie down strap guides 108 that extend between the top end 101 and the base end 102 and protrude from the outside surfaces 112, 106, 122 of the base portion 110, the corner portion 105, and the arch 125. In a representative embodiment, the plurality of tie down strap guides 108 is two tie down strap guides 108. In certain embodiments, the at least one fin 124 is a plurality of fins 124. In a representative embodiment, the plurality of fins 124 is three fins 124. In various embodiments, the plurality of fins 124 is evenly spaced. In a representative embodiment, the plurality of fins 124 comprises a fin 124 positioned closest to the corner portion 105 at a distance of approximately 40-60 millimeters.

Various embodiments provide a method 200 for securing goods. The method 200 comprises aligning 202 an angle protector 100 at a top edge of the goods. The angle protector 100 comprises an arch 125 having a generally convex outside surface 122 and a generally concave inside surface 121. The angle protector 100 comprises at least one fin 124 extending at an angle from the generally concave inside surface 121 of the arch 125. The method 200 comprises guiding 204 a tie down strap over the angle protector 100.

In a representative embodiment, the guiding 204 the tie down strap over the angle protector 100 comprises guiding 204 the tie down strap between tie down strap guides 108 protruding from an outside surface 112, 106, 122 of the angle protector 100. In certain embodiments, the method 200 comprises tightening 206 the tie down strap over the angle protector 100 to a pressure of at least 450 kilograms. In various embodiments, the method 200 comprises tightening 206 the tie down strap over the angle protector 100 to a pressure between 450 kilograms and 850 kilograms. In a representative embodiment, the goods are building materials. In certain embodiments, the building materials are plasterboard. In various embodiments, the building materials are one or more of fiber cement and timber plywood.

Although devices, methods, and systems according to the present invention may have been described in connection with a preferred embodiment, it is not intended to be limited to the specific form set forth herein, but on the contrary, it is intended to cover such alternative, modifications, and equivalents, as can be reasonably included within the scope of the invention as defined by this disclosure and appended diagrams.

While the present invention has been described with reference to certain embodiments, it will be understood by those skilled in the art that various changes may be made and equivalents may be substituted without departing from the scope of the present invention. In addition, many modifications may be made to adapt a particular situation or material to the teachings of the present invention without departing from its scope. Therefore, it is intended that the present invention not be limited to the particular embodiment disclosed, but that the present invention will include all embodiments falling within the scope of the appended claims.

What is claimed is:

1. An angle protector comprising:

a top end;

a base end;

a corner portion having an inside surface and an outside surface, the corner portion positioned between the top end and the base end;

a top portion extending between the corner portion and the top end, the top portion comprising:

an arch having a generally convex outside surface and a generally concave inside surface, the arch extending between the top end and the corner portion, and at least one fin extending at an angle toward the top end from the generally concave inside surface of the arch, wherein a first end of each of the at least one fin separately contacts a top of goods when the angle protector is aligned at a top edge of the goods; and a base portion extending between the corner portion and the base end, the base portion comprising an inside surface and an outside surface.

2. The angle protector according to claim 1, wherein the top portion comprises a foot having a flat inside surface and an outside surface, wherein:

the foot extends between the top end and the arch, and the flat inside surface contacts the top of the goods when the angle protector is aligned at the top edge of the goods.

3. The angle protector according to claim 2, wherein each of the at least one fin comprises a second end at the generally concave inside surface of the arch and the first end that is substantially on a same plane as the flat inside surface of the foot.

4. The angle protector according to claim 1, wherein the corner portion is generally C-shaped.

5. The angle protector according to claim 1, wherein the angle protector is constructed of a polycarbonate acrylonitrile-butadiene styrene alloy.

6. The angle protector according to claim 1, wherein the base portion is generally perpendicular with the top portion.

7. The angle protector according to claim 1, comprising a plurality of tie down strap guides that extend between the top end and the base end and protrude from the outside surfaces of the base portion, the corner portion, and the arch.

8. The angle protector according to claim 7, wherein the plurality of tie down strap guides is two tie down strap guides.

9. The angle protector according to claim 1, wherein the at least one fin is a plurality of fins.

10. The angle protector according to claim 9, wherein the plurality of fins is three fins.

11. The angle protector according to claim 9, wherein the plurality of fins is evenly spaced.

12. The angle protector according to claim 9, wherein the plurality of fins comprises a fin positioned closest to the corner portion at a distance of approximately 40-60 millimeters.

13. A method for securing goods, the method comprising:

aligning an angle protector at a top edge of the goods, wherein the angle protector comprises:

a top end;

a base end;

a corner portion having an inside surface and an outside surface, the corner portion positioned between the top end and the base end;

a top portion extending between the corner portion and the top end, the top portion comprising:

an arch having a generally convex outside surface and a generally concave inside surface, the arch extending between the top end and the corner portion, and at least one fin extending at an angle toward the top end from the generally concave inside surface of the arch, wherein a first end of each of the at least one fin separately contacts a top of the goods when the angle protector is aligned at the top edge of the goods; and a base portion extending between the corner portion and the base end, the base portion comprising an inside surface and an outside surface; and guiding a tie down strap over the angle protector.

14. The method according to claim 13, wherein guiding the tie down strap over the angle protector comprises guiding the tie down strap between tie down strap guides protruding from an outside surface of the angle protector.

15. The method according to claim 13, comprising tightening the tie down strap over the angle protector to a pressure of at least 450 kilograms.

16. The method according to claim 13, comprising tightening the tie down strap over the angle protector to a pressure between 450 kilograms and 850 kilograms.

17. The method according to claim 13, wherein the goods are building materials.

18. The method according to claim 17, wherein the building materials are plasterboard.

19. The method according to claim 17, wherein the building materials are one or more of fiber cement and timber plywood.

20. The method according to claim 13, wherein:

the top portion comprises a foot having a flat inside surface and an outside surface, wherein the foot extends between the top end and the arch, and wherein the flat inside surface contacts the top of the goods when the angle protector is aligned at the top edge of the goods, and each of the at least one fin comprises a second end at the generally concave inside surface of the arch and the first end that is substantially on a same plane as the flat inside surface of the foot.

* * * * *